US007162938B1

(12) United States Patent
Peters

(10) Patent No.: US 7,162,938 B1
(45) Date of Patent: Jan. 16, 2007

(54) MAGNETIC WRENCH ATTACHMENT

(76) Inventor: Thomas Peters, 205 S. Berlin St., Schaller, IA (US) 51053

( * ) Notice: Subject to any disclaimer, the term of this patent is extended or adjusted under 35 U.S.C. 154(b) by 9 days.

(21) Appl. No.: 11/131,855

(22) Filed: May 18, 2005

(51) Int. Cl.
*B25B 13/02* (2006.01)
*B25B 13/58* (2006.01)

(52) U.S. Cl. ..... 81/125; 81/180.1

(58) Field of Classification Search ..... 81/125, 81/180.1, 13
See application file for complete search history.

(56) References Cited

U.S. PATENT DOCUMENTS 1,352,461 A * 9/1920 Lenholt ..... 81/125.1
1,550,436 A * 8/1925 Hall ..... 81/119
2,557,628 A * 6/1951 Becker ..... 81/125
2,567,352 A * 9/1951 Rozmus ..... 81/125
4,406,188 A * 9/1983 Mills ..... 81/180.1
4,718,316 A * 1/1988 Dedrick ..... 81/125
4,787,273 A * 11/1988 Griffith ..... 81/13

* cited by examiner

*Primary Examiner*—David B. Thomas
(74) *Attorney, Agent, or Firm*—G. Brian Pingel; Camille L. Urban; Adam W. Jones

(57) ABSTRACT

The present invention is an attachment that fits onto the head of a wrench to magnetically hold a nut. The attachment has a magnetized surface and a side surface to friction fit onto a wrench. Fit is further improved by magnetizing the side surface. By holding the nut, the attachment allows for operation of a wrench in restrictive spaces where manual holding of the nut would be impossible or impracticable. Making side surfaces of the attachment out of plastic allows the attachment to adapt to different sizes of wrench heads. A hole in the attachment allows a bolt to pass through the attachment as it passes through the nut.

20 Claims, 7 Drawing Sheets

MAGNETIC WRENCH ATTACHMENT

CROSS-REFERENCE TO RELATED APPLICATIONS

This application is based upon Applicant's prior abandoned application, U.S. Ser. No. 09/459/221, the entire contents of which are incorporated herein by reference.

BACKGROUND OF THE INVENTION

1. Field of the Invention

The present invention relates in general to an attachment or improvement to wrenches to secure a nut to a wrench head for fastening to a bolt. Specifically, the present invention relates to a magnetized attachment to a wrench head for holding a nut in place so as to enable fastening to a bolt in an area where the operator cannot hold the nut in place by hand.

2. Description of the Prior Art

A common problem with the use of wrenches is the limitation of working space. Specifically, since a wrench (also referred to in the art as box wrench, closed wrench, crescent wrench, and fixed wrench among other terms) has an open end, the nut or bolt head inserted therein is precariously retained and must be kept in place by hand until it is secured on the thread of the bolt. However, when the space is too limited to hold the nut by hand (e.g., when working on a crevice in an engine block or behind a large appliance) the user must attempt to balance the nut on the sides of the box wrench. This precarious method of retention frequently results in dislodging the nut during attempts to attach to the thread of a bolt, thus resulting in aggravation and the loss of time in locating the nut. When this happens to a professional mechanic, this problem results in a loss of time and money.

Existing attempts to address these problems involve the use of complex arrangement such as magnetized wrench heads and magnetized washer combinations that require individual fittings tailored to the specific wrench size and specialized magnetic wrenches. In addition, such magnetized wrenches may cause unwanted attractions to other metallic surfaces in the working area. Other attempts at addressing the secure attachment of such fasteners deal with socket wrenches, which are not configured for use in narrow areas and thus do not address the problems solved by the present invention.

SUMMARY

The apparatus of the present invention comprises an attachment for enabling the secured attachment by a wrench of a nut to a bolt in a space that is too restricted for manual manipulation. Specifically, the present invention provides for a cap-like attachment to a wrench having open ends which would be incapable of safely holding, by itself, a nut for attachment to a bolt. The attachment includes a bottom surface and a side surface. The side surface wraps around at least a portion of the wrench head and is notched to fit around the handle of the wrench. The inner face of the bottom surface that faces the wrench head is magnetized to hold the nut in place by magnetic attraction.

Another preferred embodiment of the present invention also has magnetic material disposed on the interior surface of the side surfaces so as to ensure a magnetic fit with the wrench head as well as a friction fit. Yet another preferred embodiment of the present invention includes an attachment made of elastomeric material so as to allow for a kind of "one size fits all" attachment capable of fitting a wide variety of wrench heads. Still another preferred embodiment of the present invention includes an aperture defined within the bottom surface of the attachment so as to facilitate receipt of the shaft of a bolt or similar fastener. Most preferably, this embodiment would have an aperture of sufficient size to accommodate a bolt shaft, but not so large as to allow displacement of the nut. Finally, another preferred embodiment of the present invention calls for a non-magnetic (e.g. plastic) material disposed on the side and bottom surfaces of the attachment facing away form the wrench head, thus preventing magnetic forces from pulling the attachment (and thus, the wrench) away from the desired operating site.

Accordingly, one object of the present invention is to provide a wrench modified to operate in highly restricted physical spaces.

Another object of the present invention is to provide nut holding capability to conventional wrenches so as to facilitate their operation in highly restricted physical spaces.

Yet another object of the present invention is to facilitate the magnetic attraction of a nut to a wrench head while avoiding undesired magnetic attractions to other metallic surfaces in a working area.

Still another object of the present invention is to permit the throughput of a bolt through a nut while still ensuring the secure magnetic attachment of a nut within the interior area of the wrench head.

These and other objects, features, and advantages of the present invention will become more apparent in light of the following detailed description of embodiments thereof, and as illustrated in the accompanying drawings.

Other objects, features, and advantages of the present invention will be readily appreciated from the following description. The description makes reference to the accompanying drawings, which are provided for illustration of the preferred embodiment. However, such embodiments do not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
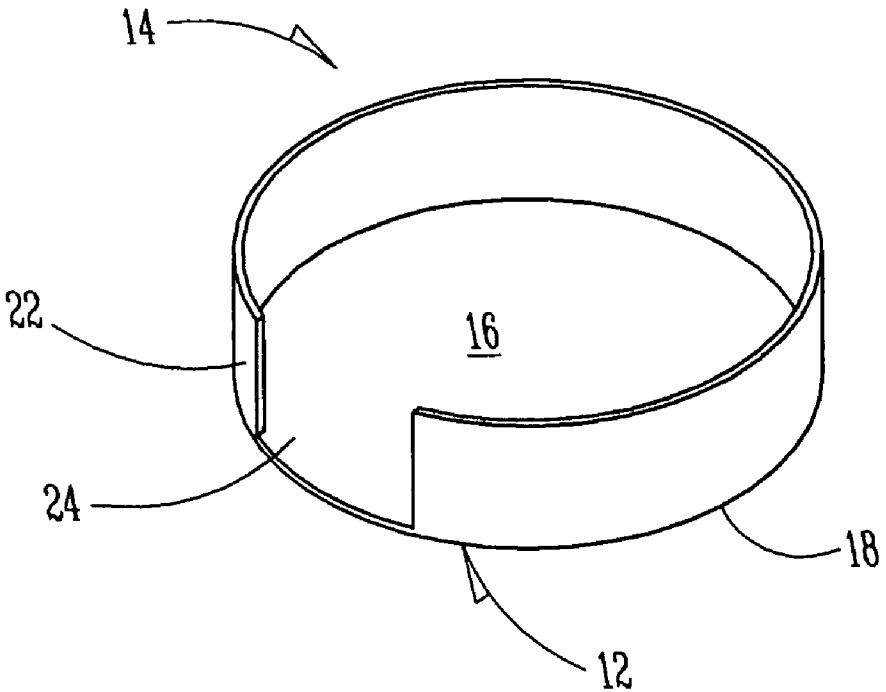
FIG. 1 is a perspective view of a preferred embodiment of the present invention.

As seen in FIG. 1, the present invention is an attachment 10 having a bottom surface 12 and a side surface 14. The bottom surface 12 has an inner face 16 and an outer face 18. The inner face 16 is at least in part magnetic. The side surface 14 extends away from and nearly encircles inner face 16. The side surface further defines an interior surface 20 and an exterior surface 22. In the preferred embodiment, the side surface 14 is perpendicular to bottom surface 12 and defines a notch 24.

Figure 2A:
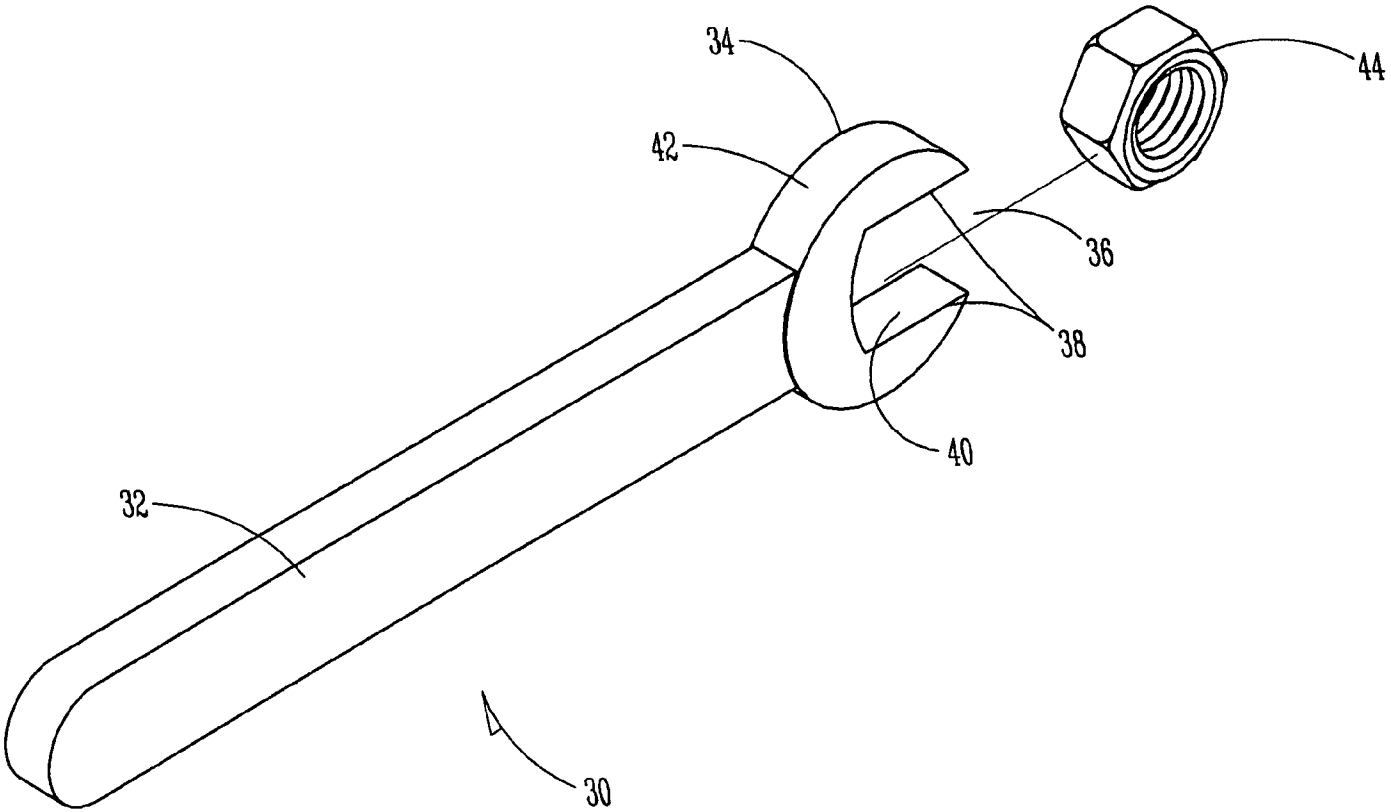
FIG. 2*a* is a perspective view of a nut and a conventional wrench having jaws. The dashed line indicates the insertion of the nut.
Figure 2B:
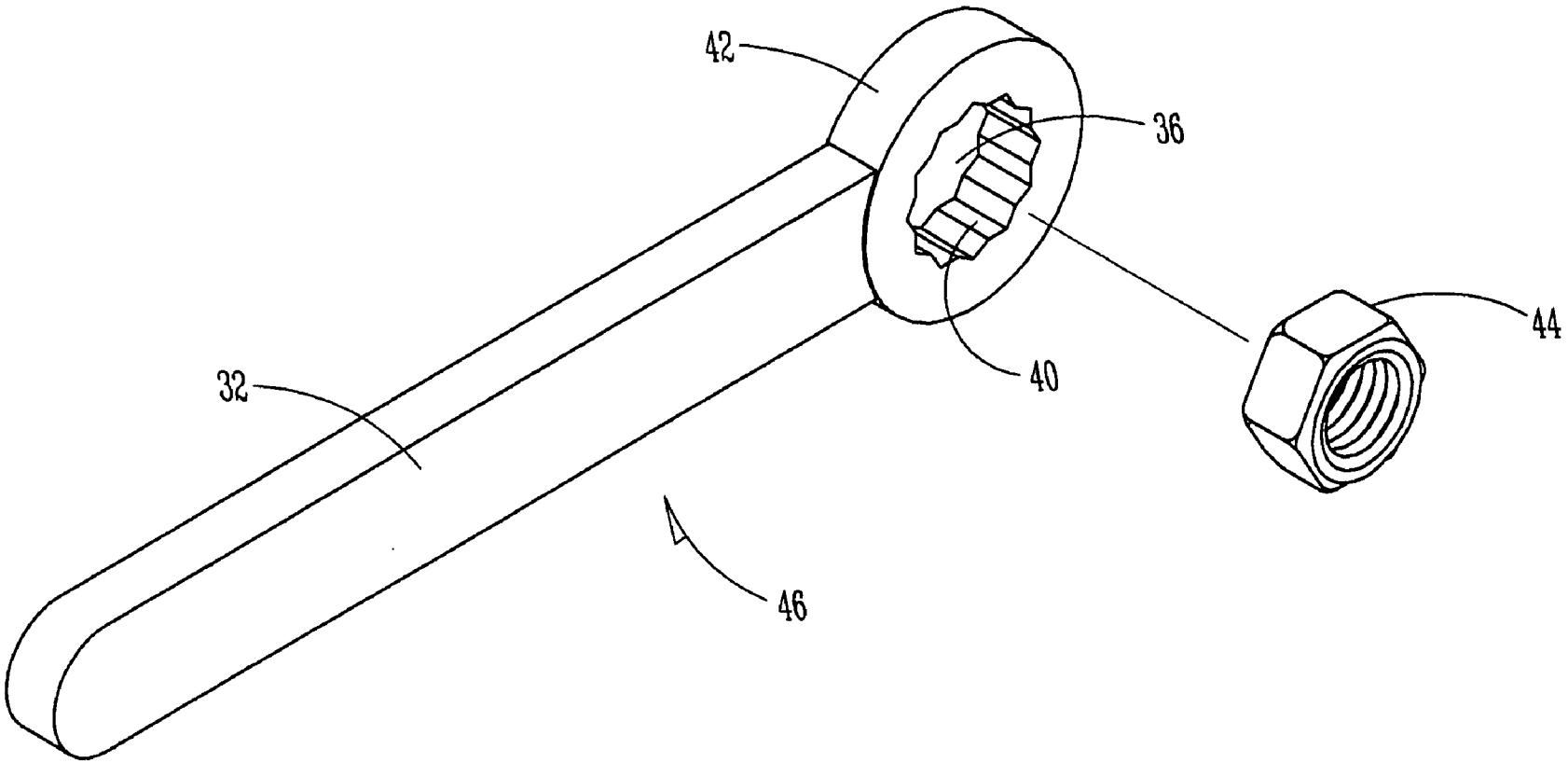
FIG. 2*b* is a perspective view of a nut and a conventional wrench having a closed box. The dashed line indicates the insertion of the nut.

FIGS. 2*a* and 2*b* show a wrench 30 as is known in the art. The wrench 30 includes a handle 32 and one or more of a head 34 defining an open end 36. In one known embodiment of a prior art wrench 30 shown in FIG. 2*a*, the head 34 has a jaws 38 defining an interior region 40 and an exterior region 42. It is the interior region 40 that comes into contact with a nut 44. In another known embodiment of a wrench 30 shown in FIG. 2*b*, the head 10 has a closed box 46 instead of jaws 38, but the closed box 46 still has the interior region 40 and the exterior region 42 and the interior region 40 comes into contact with a nut 44. The prior art wrench 30 is not magnetized and does not hold a nut 44 in place.

Figure 3A:
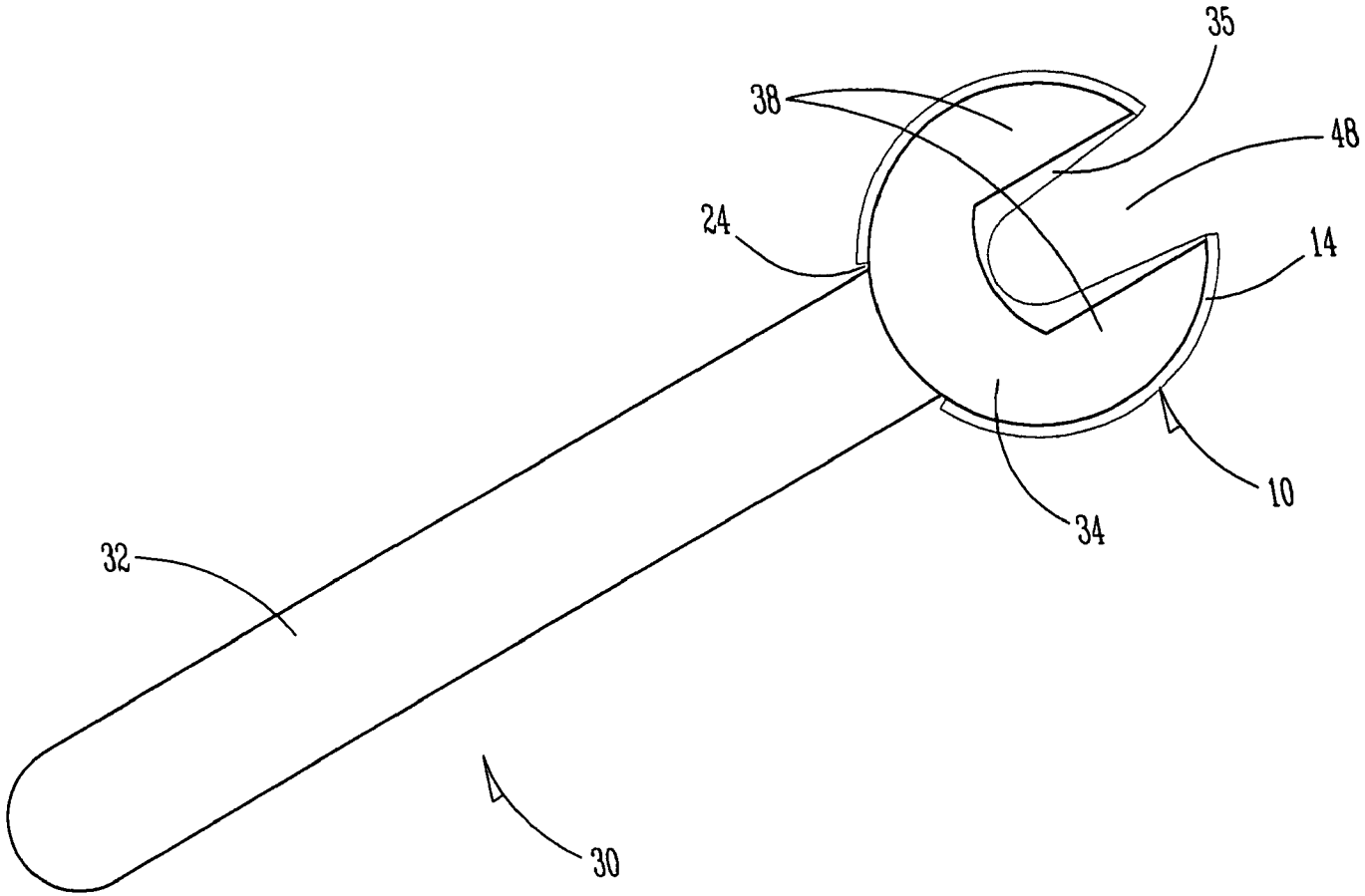
FIG. 3*a* is a perspective view of a preferred embodiment of the present invention in interaction with the wrench of FIG. 2*a*.
Figure 3B:
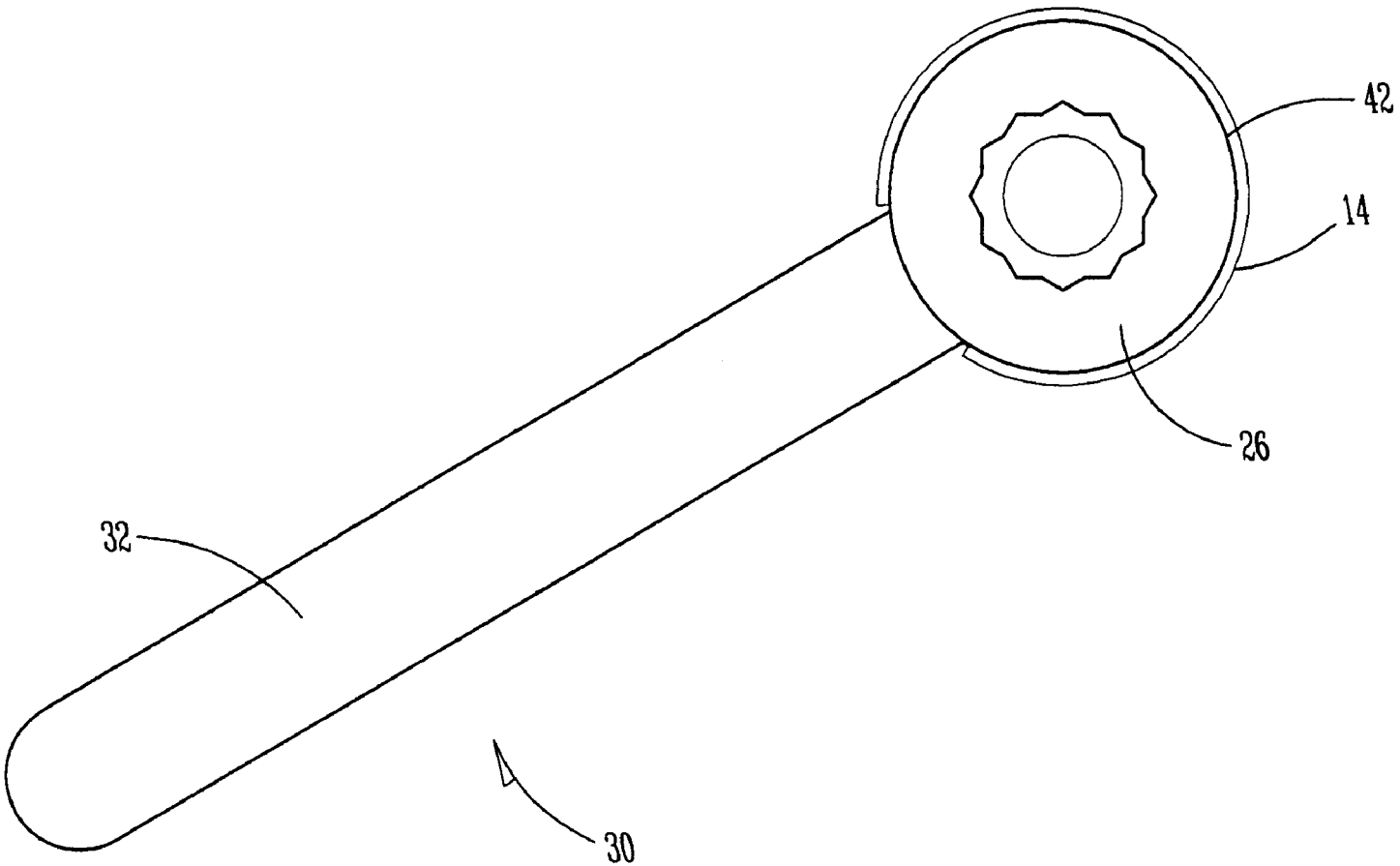
FIG. 3*b* is a perspective view of a preferred embodiment of the present invention in interaction with the wrench of FIG. 2*b*.

The side surface 14 and the inner face 16 is so shaped that attachment 10 friction fits or snaps into place onto wrench head 34 as shown in FIGS. 3*a* and 3*b*. The notch 24 corresponds to the handle 32 where the handle 32 connects to head 34. In the preferred embodiment for a wrench 30 with jaws 38 shown in FIG. 3*a*, the side surface 14 defines a gap 48. The gap 48 corresponds to the open end 36 between the jaws 38. In the preferred embodiment for a wrench 30 with closed box 26 shown in FIG. 3*b*, the side surface 14 defines no such gap 48, but instead the side surface 14 extends contiguously along the exterior region 42.

In either preferred embodiment the attachment 10 is snapped into place in operation such that inner face 16 is flush with or in very close proximity with wrench head 34. This ensures that the wrench head 34 with the attachment 10 maintains a low profile. In this manner, the attachment 10 does not make the wrench too bulky to operate in highly restrictive physical spaces.

Figure 4A:
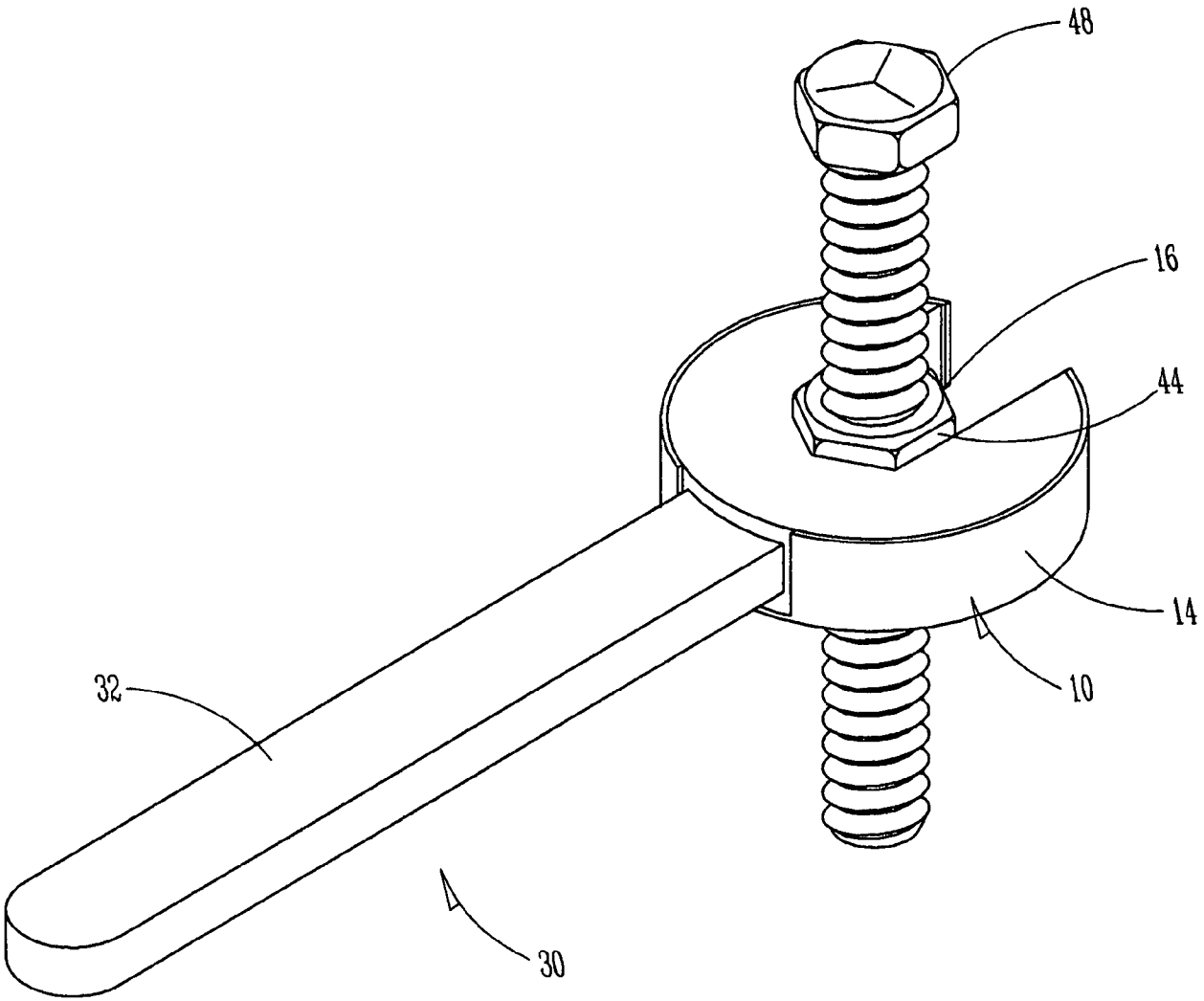
FIG. 4*a* is a perspective view of a preferred embodiment of the present invention and the wrench of FIG. 3*a* in mating engagement with a nut and bolt.
Figure 4B:
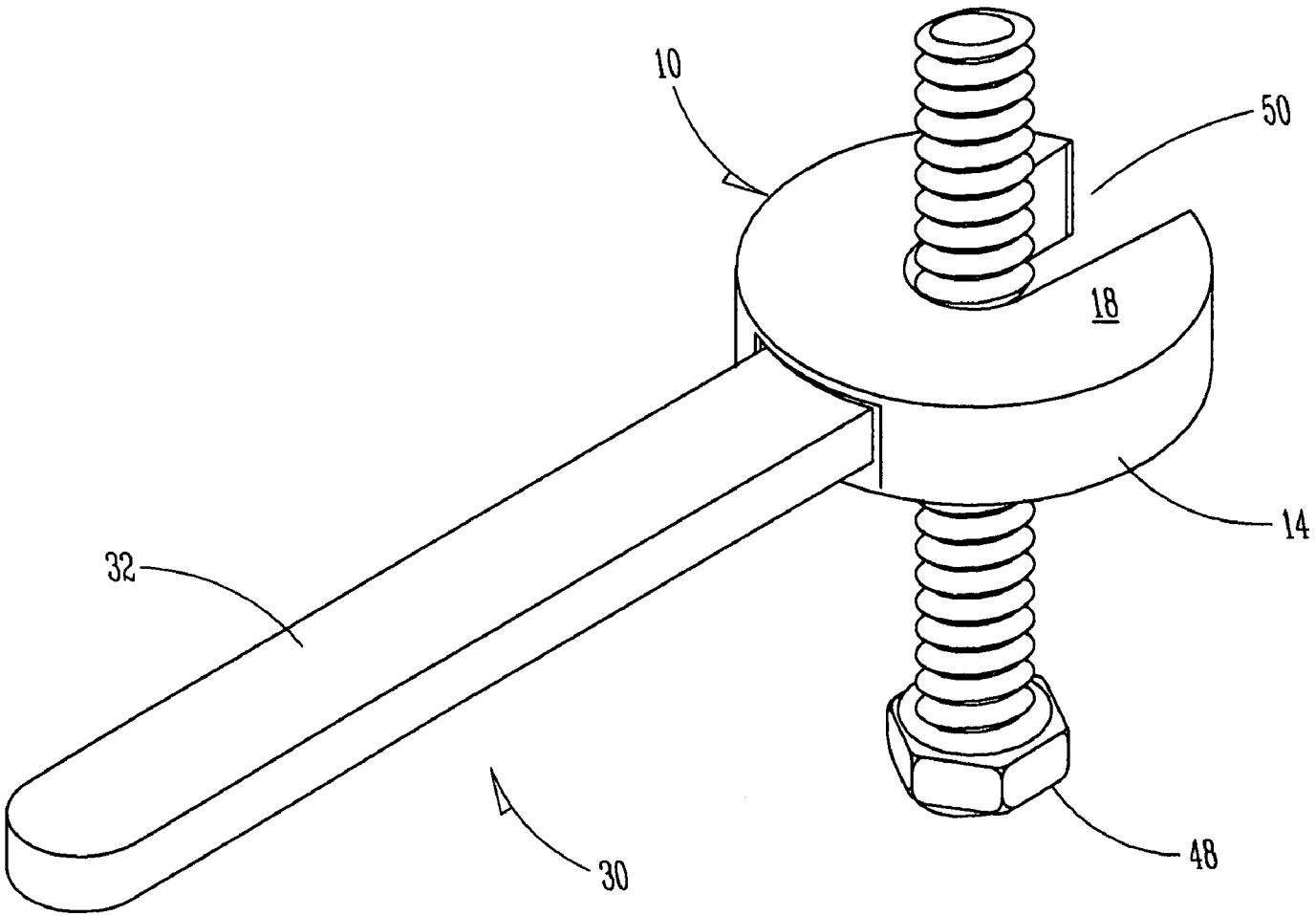
FIG. 4*b* is a perspective view of the preferred embodiment of FIG. 4*a* flipped over to show the opposite side.

Mating engagement of the attachment 20, the wrench 30, the nut 44, and a bolt 48 is illustrated in FIG. 4. In order for a bolt to pass through a nut as in FIG. 4, the bottom surface 12 of the preferred embodiment further defines an aperture 50, as seen in FIG. 4*b*. In the preferred embodiment the aperture 50 is sized to accommodate various sizes of the bolt 50 but small enough to prevent physical displacement of the nut 44.

In another preferred embodiment, the inner surface 40 of the side surface 14 is at least partially magnetized to additionally magnetic attraction fit the attachment 10 to the head 34. In yet another preferred embodiment, the side surface 14 is elastomeric, i.e. stretchable, and allows the attachment 10 to be fit onto wrench heads 34 of varying sizes. In the preferred embodiment, the elastomeric material is plastic. Forming the side surface 14 and the bottom surface 12 of plastic or other non magnetic materials has the benefit of reducing unwanted magnetic interactions with the attachment 10.

Thus, the present invention has been described in an illustrative manner. It is to be understood that the terminology that has been used is intended to be in the nature of words of description rather than of limitation.

Many modifications and variations of the present invention are possible in light of the above teachings. For example, only enough of the inner face 16 need be magnetized as necessary to retain the nut 44 or remain affixed to wrench head 34, but all of inner face 16 may be magnetized. As another example, the attachment 10 may be adapted to different types of wrenches, and is not limited to the illustrative examples shown in the drawings and described herein. Therefore, within the scope of the appended claims, the present invention may be practiced otherwise than as specifically described.

I claim:

1. An attachment for a wrench, said wrench including a handle and at least one head, said wrench head including an exterior region and an interior region defining an open end adapted to matingly receive a nut and operable to engage said nut with a bolt, said attachment comprising:

a substantially circular bottom surface;

a side surface extending from said bottom surface;

said side surface includes an exterior surface and an inner surface for frictionally engaging at least a portion of said exterior region of said wrench head;

said bottom surface includes an outer face and an inner face surrounded by said side surface and at least partially magnetized to magnetically engage a nut; and said side surface defining a notch corresponding to said handle of said wrench such that said side surface fits around said handle and said inner face is flush with said wrench head.

2. The Attachment of claim 1, wherein said side surface extends substantially perpendicular from said bottom surface.

3. The attachment of claim 1, wherein said side surface is comprised of an elastomeric material so as to be adapted to varying sizes of said wrench head.

4. The attachment of claim 3, wherein said elastomeric material is plastic.

5. The attachment of claim 1, wherein said outer face of said bottom surface and said exterior surface of said side surface are non-magnetizable.

6. The attachment of claim 1, wherein said bottom surface defining an aperture so as to accommodate the bolt as it threads past the nut.

7. The attachment of claim 6, wherein said aperture allows pass through of said bolt but not of said nut.

8. The attachment of claim 1, wherein said inner surface of said side surface is at least partially magnetized to magnetically engage said exterior region of said wrench head.

9. The attachment of claim 1, wherein said wrench head comprises jaws defining said open end and said side surface defining a gap corresponding to said open end.

10. An attachment for a wrench, said wrench including a handle and at least one head, said wrench head including an exterior region and an interior region defining an open end adapted to matingly receive a nut and operable to engage said nut with a bolt, said attachment comprising:

a substantially circular bottom surface;

a side surface extending substantially perpendicular from said bottom surface;

said side surface includes an exterior surface and an inner surface for frictionally engaging at least a portion of said exterior region of said wrench head;

said bottom surface includes an outer face and an inner face surrounded by said side surface and at least partially magnetized to magnetically engage a nut;

said side surface defining a notch corresponding to said handle of said wrench such that said side surface fits around said handle and said inner face is flush with said wrench head;

said bottom surface defining an aperture so as to accommodate the bolt as it threads past the nut; and said aperture allows pass through of said bolt but not of said nut.

11. The attachment of claim 10, wherein said side surface is comprised of an elastomeric material so as to be adapted to varying sizes of said wrench head.

12. The attachment of claim 11, wherein said elastomeric material is plastic.

13. The attachment of claim 10, wherein said outer face of said bottom surface and said exterior surface of said side surface are non-magnetizable.

14. The attachment of claim 10, wherein said inner surface of said side surface is at least partially magnetized to magnetically engage said exterior region of said wrench head.

15. The attachment of claim 10, wherein said wrench head comprises jaws defining said open end and said side surface defining a gap corresponding to said open end.

16. An attachment for a wrench, said wrench including a handle and at least one head, said wrench head including jaws defining an exterior region, an interior region, and an open end adapted to matingly receive a nut and operable to engage said nut with a bolt, said attachment consisting of:

a substantially circular bottom surface;

a side surface extending substantially perpendicular from said bottom surface;

said side surface includes an exterior surface and an inner surface for frictionally engaging at least a portion of said exterior region of said wrench head;

said bottom surface includes an outer face and an inner face surrounded by said side surface and at least partially magnetized to magnetically engage a nut;

said side surface defining a notch corresponding to said handle of said wrench such that said side surface fits around said handle and said inner face is flush with said wrench head;

said side surface defining a gap corresponding to said open end of said wrench;

said bottom surface defining an aperture so as to accommodate the bolt as it threads past the nut; and said aperture is at least allows pass through of said bolt but not of said nut.

17. The attachment of claim 16, wherein said side surface is comprised of an elastomeric material so as to be adapted to varying sizes of said wrench head.

18. The attachment of claim 17, wherein said elastomeric material is plastic.

19. The attachment of claim 16, wherein said outer face of said bottom surface and said exterior surface of said side surface are non-magnetizable.

20. The attachment of claim 16, wherein said inner surface of said side surface is at least partially magnetized to magnetically engage said exterior region of said wrench head.

* * * * *